US006068461A

United States Patent [19]

Haga et al.

[11] Patent Number: 6,068,461

[45] Date of Patent: May 30, 2000

[54] VANE TYPE ROTARY PUMP HAVING A DISCHARGE PORT WITH A TAPERED BEARDED GROOVE

[75] Inventors: Kyosuke Haga, Anjo; Hidetoshi Fujiwara, Aichi-ken; Motoyasu Yamamori, Nagoya, all of Japan

[73] Assignee: Toyoda Koki Kabushiki Kaisha, Kariya, Japan

[21] Appl. No.: 08/931,961

[22] Filed: Sep. 17, 1997

[30] Foreign Application Priority Data

Sep. 17, 1996 [JP] Japan ..... 8-265106

[51] Int. Cl.[7] ..... F04C 2/344

[52] U.S. Cl. ..... 418/180; 418/259

[58] Field of Search ..... 418/180, 259

[56] References Cited

U.S. PATENT DOCUMENTS

| | | | |
|---|---|---|---|
| 3,781,145 | 12/1973 | Wilcox | 418/1 |
| 4,610,614 | 9/1986 | Haga et al. | 418/269 |
| 4,619,595 | 10/1986 | Amano et al. | 418/259 |
| 4,913,636 | 4/1990 | Niemiec | 418/268 |
| 5,046,933 | 9/1991 | Haga et al. | 418/180 |
| 5,518,380 | 5/1996 | Fujii et al. | 418/26 |

FOREIGN PATENT DOCUMENTS

| | | |
|---|---|---|
| 40 19 097 | 1/1991 | Germany . |
| 57-30396 | 2/1982 | Japan . |
| 6-12779 | 2/1994 | Japan . |
| 2 197 030 | 5/1988 | United Kingdom . |

*Primary Examiner*—John J. Vrablik

*Attorney, Agent, or Firm*—Oblon, Spivak, McClelland, Maier & Neustadt, P.C.

[57] ABSTRACT

A vane type rotary pump including a stator housing, a cam ring formed at its inner periphery with a cam surface and mounted within the stator housing, a pair of end wall structures fitted to the opposite ends of the cam ring to form a pump cavity in the cam ring, a drive shaft rotatably mounted within the stator housing and extending into the interior of the pump cavity through one of the end wall structures, a rotor contained within the cam ring and mounted on the drive shaft for rotation therewith, and a plurality of circumferentially equally spaced vanes slidably fitted into the body of the rotor to move radially outward from the rotor and cooperating with the cam surface of the cam ring to form a plurality of expandable pump chambers, wherein one of the end wall structures is formed at its inside face with a suction port at a portion where the pump chambers expand as the vanes move radially outward and is formed at its inside face with a discharge port at a portion where the pump chambers contract as the vanes move radially inward and a bearded groove tapered from a forward end of the discharge port in a direction opposite to a rotational direction of the rotor; the vane type rotary pump being characterized in that the bearded groove is formed with an introducing portion the surface of which is inclined into the interior of the discharge port.

3 Claims, 9 Drawing Sheets

VANE TYPE ROTARY PUMP HAVING A DISCHARGE PORT WITH A TAPERED BEARDED GROOVE

BACKGROUND OF THE INVENTION

1. Field of the Invention

The present invention relates to a vane type rotary pump for supplying hydraulic fluid under pressure to a hydraulically operated apparatus such as a power-assisted steering apparatus in an automotive vehicle.

2. Description of the Prior Art

A conventional vane type rotary pump of this kind is composed of a stator housing, a cam ring formed at its inner periphery with a cam surface radially offset from its central axis and mounted within the stator housing, a pair of end wall structures fitted to the opposite ends of the cam ring to form a pump cavity in the cam ring, a drive shaft rotatably mounted within the stator housing and extending into the interior of the pump cavity through one of the end wall structures, a rotor contained within the cam ring and mounted on the drive shaft for rotation therewith, and a plurality of circumferentially equally spaced vanes slidably fitted into the body of the rotor to move radially outward from the rotor and cooperating with the cam surface of the cam ring to form a plurality of expandable pump cambers. In the vane type rotary pump, one of the end wall structures is formed with a suction port at a portion where the pump chambers expand as the vanes move radially outward and is formed with a discharge port at a portion where the pump chambers contract as the vanes move radially inward.

In operation, the fluid compressed at the compression stroke suddenly changes in pressure when discharged into the discharge port. This causes pulsation of the fluid under pressure, resulting in the occurrence of vibration and unpleasant noises in the pump assembly. To solve such problems, there has been proposed a vane type rotary pump in Japanese Utility Model Laid-open Publication 57(1982)-30396, wherein one of the end wall structures 60 is formed at its inside face with a bearded groove 62 which is tapered from the discharge port 61 in a direction opposite to a rotational direction of the rotor as shown in FIG. 8 to gradually increase the pressure of fluid discharged into the discharge port. However, the bearded groove 62 is communicated with the discharge port 61 at a shoulder 63 of the end wall structure 60. With such a configuration of the bearded groove, the pressure in a pump chamber formed by adjacent vanes passing the suction port rapidly increases under a loaded condition of the rotary pump at a point of time shown by a character θ1 in FIG. 9(*b*), and the fluid under pressure in the discharge port 61 is introduced into the pump chamber through the bearded groove 62 immediately before the pump chamber is fully communicated with the discharge port 61. This causes an overshoot S' in pressure of the fluid shown in FIG. 9(*b*), resulting in a decrease S" of the pressure of fluid in a moment θ2 shown in FIG. 9(*a*) when the pump chamber was fully communicated with the discharge port 61. For this reason, the provision of the bearded groove does not effect to avoid pulsation of the hydraulic fluid pressure and to eliminate the occurrence of vibration and unpleasant noises in the pump assembly.

SUMMARY OF THE INVENTION

It is, therefore, a primary object of the present invention is to provide a vane type rotary pump capable of restraining the occurrence of pulsation of the fluid under pressure and of eliminating the vibration and unpleasant noise discussed above.

According to the present invention, the object is accomplished by providing a vane type rotary pump or compressor including a stator housing, a cam ring formed at its inner periphery with a cam surface and mounted within the stator housing, a pair of end wall structures fitted to the opposite ends of the cam ring to form a pump cavity in the cam ring, a drive shaft rotatably mounted within the stator housing and extending into the interior of the pump cavity through one of the end wall structures, a rotor contained within the cam ring and mounted on the drive shaft for rotation therewith, and a plurality of circumferentially equally spaced vanes slidably fitted into the body of the rotor to move radially outward from the rotor and cooperating with the cam surface of the cam ring to form a plurality of expandable pump chambers, wherein one of the end wall structures is formed at its inside face with a suction port at a portion where the pump chambers expand as the vanes move radially outward and is formed at its inside face with a discharge port at a portion where the pump chambers contract as the vanes move radially inward and a bearded groove tapered from a forward end of the discharge port in a direction opposite to a rotational direction of the rotor; the vane type rotary pump being characterized in that said bearded groove is formed with an introducing portion the surface of which is inclined into the interior of said discharge port.

BRIEF DESCRIPTION OF THE ACCOMPANYING DRAWINGS

Other objects, features and advantages of the present invention will be more readily appreciated from the following detailed description of a preferred embodiment and modifications thereof when taken together with the accompanying drawings, in which:

FIG. 5(*b*) is a graph showing fluid pressure in a pump chamber formed by adjacent vanes in the rotary pump in relation to the rotation angle of the rotor in the rotary pump;

FIG. 7(*b*) is a cross-sectional view illustrating another modification of the introducing portion shown in FIGS. 3 and 4;

FIG. 9(*b*) is a graph showing fluid pressure in a pump chamber formed by adjacent vanes in the conventional rotary pump.

DETAILED DESCRIPTION OF THE PREFERRED EMBODIMENT

Figure 1:
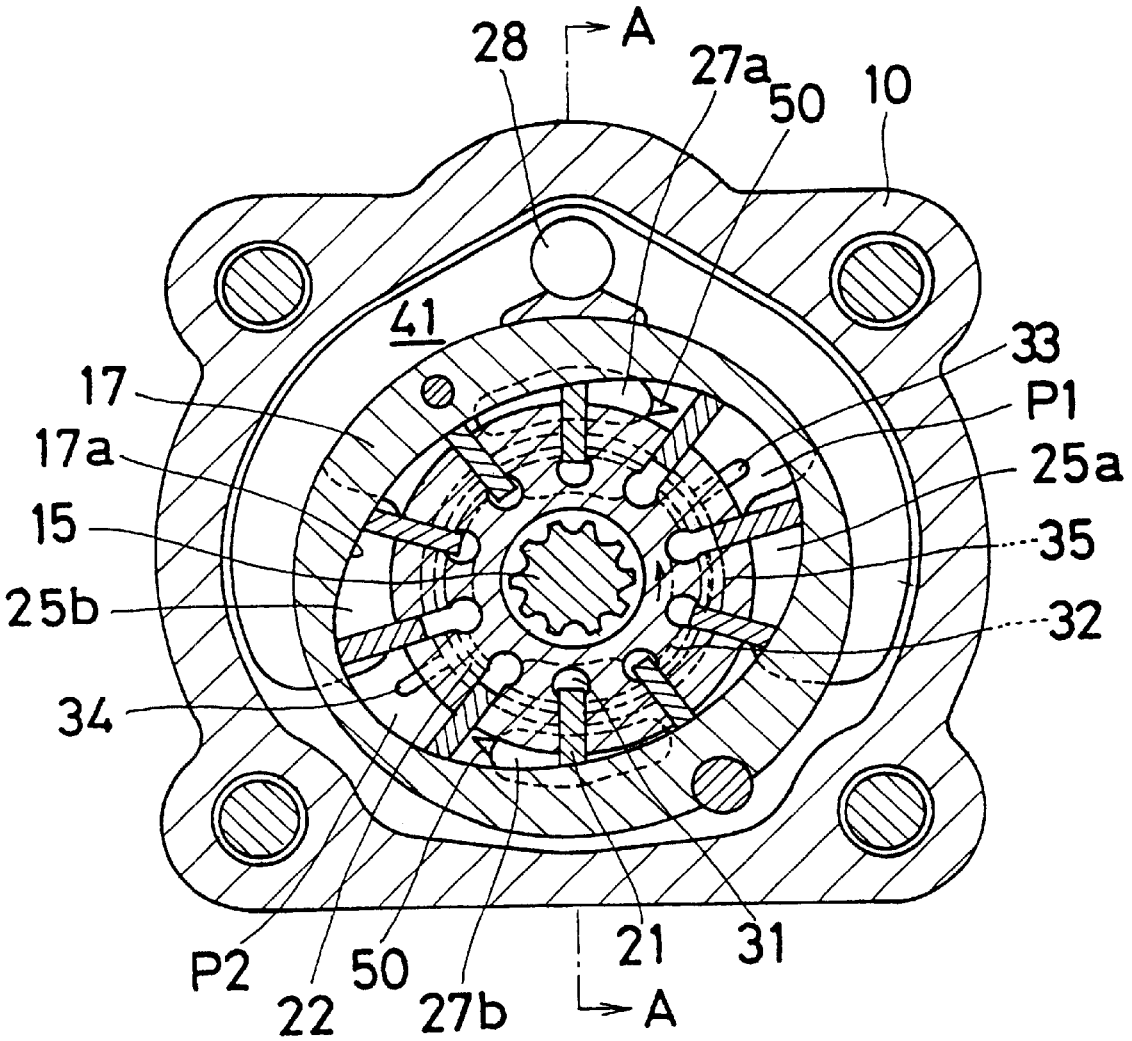
FIG. 1 is a vertical sectional view of a vane type rotary pump in accordance with the present invention.
Figure 2:
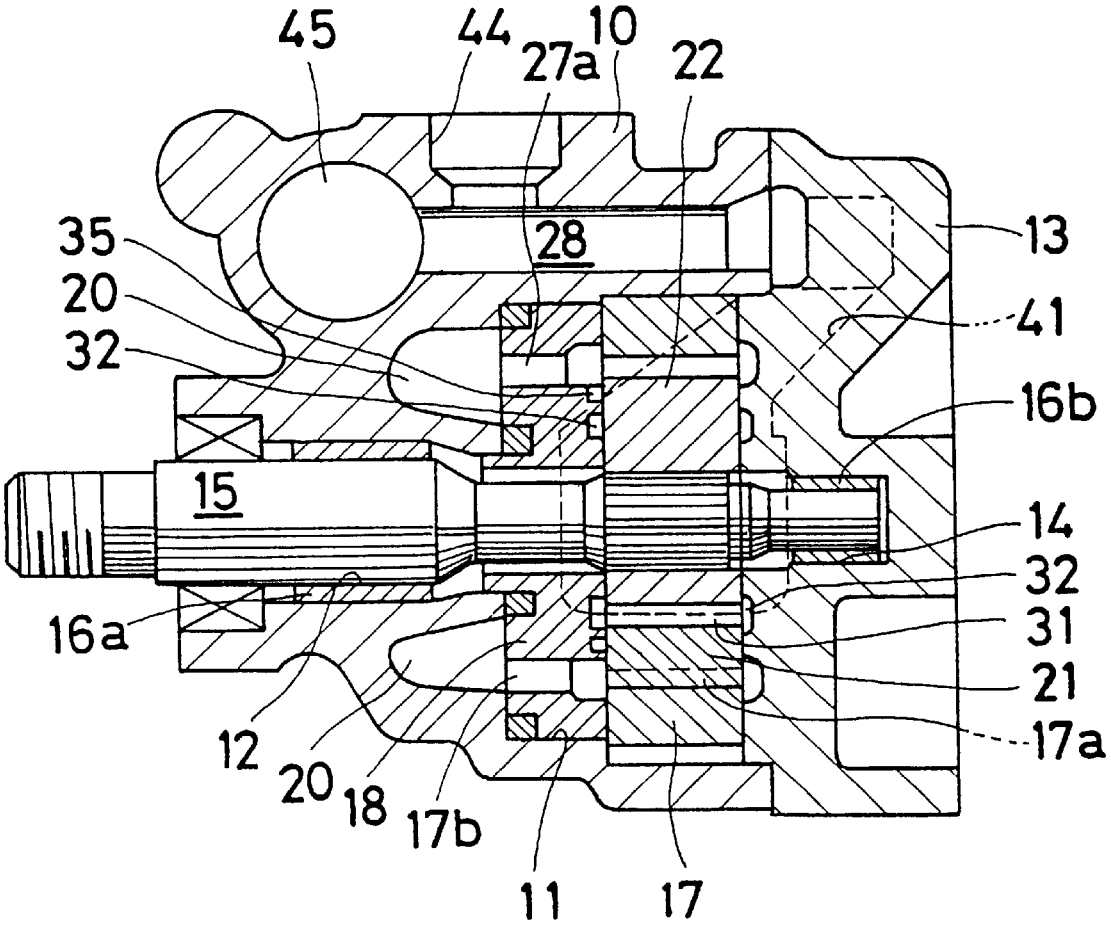
FIG. 2 is a cross-sectional view taken along line A—A in FIG. 1.

Illustrated in FIGS. 1 and 2 of the drawings is a vane type rotary pump in accordance with the present invention, which rotary pump includes a stator housing 10 formed therein with a stepped cylindrical bore 11 and an axial bore 12, a right-hand end wall member 13 in the form of a closure member coupled with an opening end of stator housing 10 in a fluid-tight manner to close the cylindrical bore 11, and a drive shaft 15 rotatably mounted within the stator housing 10. The right-hand end wall member 13 is formed with a counter bore 14 coaxially with the axial bore 12. The drive shaft 15 is supported by a pair of axially spaced bearings 16*a* and 16*b* coupled within the axial bore 12 and the counter bore 14.

A cam ring 17 is mounted within the cylindrical bore 11 of stator housing 10 and fitted at one side thereof with the right-hand end wall member 13 and at the other side thereof with a left-hand end wall member 18 coupled within the cylindrical bore 11. The cam ring 17 has an inner peripheral wall defining a pair of diametrically opposed cam surfaces 17*a* which are symmetrically arranged with respect to the central axis of drive shaft 15. A rotor 22 is contained within the cam ring 17 and mounted on the drive shaft 15 for rotation therewith. A plurality of circumferentially equally spaced vanes 21 are slidably fitted in the body of rotor 22 to move radially outward from the rotor 22. In operation of the rotary pump, the vanes 21 cooperate with the cam surfaces 17a of cam ring 17 and the inside faces of end wall members 13 and 18 to form a plurality of expandable pump chambers P1 and P2 each displacement capacity of which is varied by rotation of the rotor 22.

The left-hand end wall member 18 is formed at its inside face with a pair of diametrically opposed suction ports 25*a* and 25*b* each at a portion where the pump chambers expand as the vanes 21 move radially outward from the rotor. The left-hand end wall member 18 is also formed at its inside face with a pair of diametrically opposed discharge ports 27*a* and 27*b* each at a portion where the pump chambers contract as the vanes 21 move radially inward. In addition, the left-hand end wall member 18 has an annular back pressure groove 32 formed at its inside face coaxially with the rotor 22 and communicated with back pressure chambers 31 formed by each inner end of vanes 21. The annular back pressure groove 32 is communicated with the discharge ports 27*a* and 27*b* through communication passages (not shown). A pair of diametrically opposed radial notches 33 and 34 are formed on the inside face of left-hand end wall 18 respectively between the suction port 25*a* and discharge port 27*a* and between the suction port 25*b* and discharge port 27*b*.

These radial notches 33 and 34 are communicated at their inner ends with an annular communication groove 35 formed on the inside face of left-hand end wall member 18 coaxially with the rotor 22 to communicate therethrough the pump chambers P1 and P2 to one another.

The stator housing 10 is formed at an upper end portion thereof with an inlet port 44 for connection to a fluid reservoir (not shown) of the rotary pump. The suction ports 25*a*, 25*b* are communicated with the inlet port 44 through a cavity 41 formed in the right-hand end wall member 13 and a bypass passage 28 formed in the stator housing 10, while the discharge ports 27*a*, 27*b* are in open communication with a pressure chamber 20 which is communicated with an outlet port (not shown) for connection to a hydraulically operated apparatus such as a power-assisted steering apparatus in an automotive vehicle. Formed between the pressure chamber 20 and bypass passage 28 is a cylindrical cavity 45 for containing a spool of a flow control valve assembly (not shown) which is arranged to discharge an excessive amount of fluid under pressure from the pressure chamber 20 into the bypass passage 28 for supplying a predetermined amount of fluid under pressure to the hydraulically operated apparatus through the outlet port.

Figure 3:
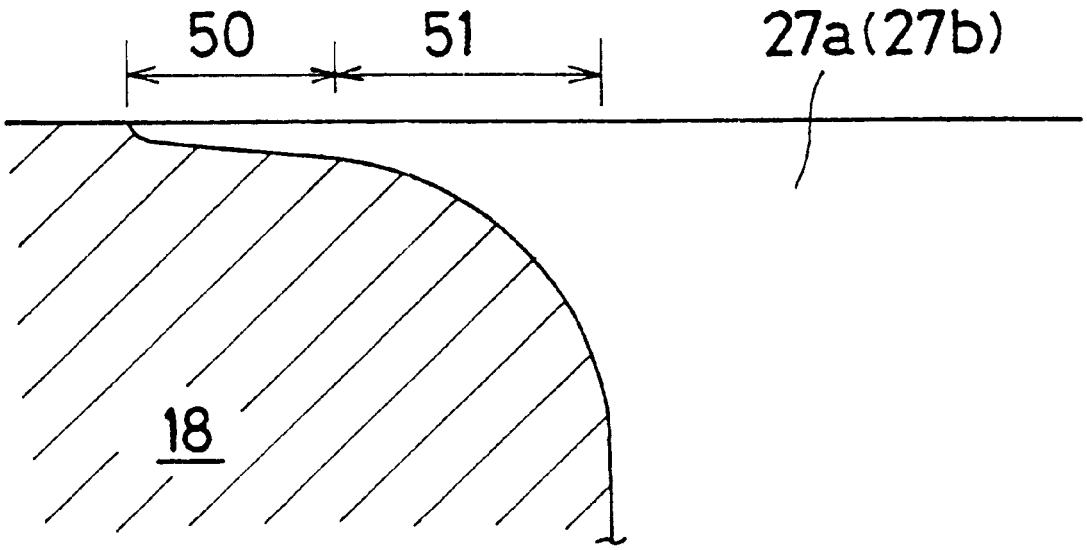
FIG. 3 is an enlarged cross-sectional view of a bearded groove and an introducing portion shown in FIG. 1.
Figure 4:
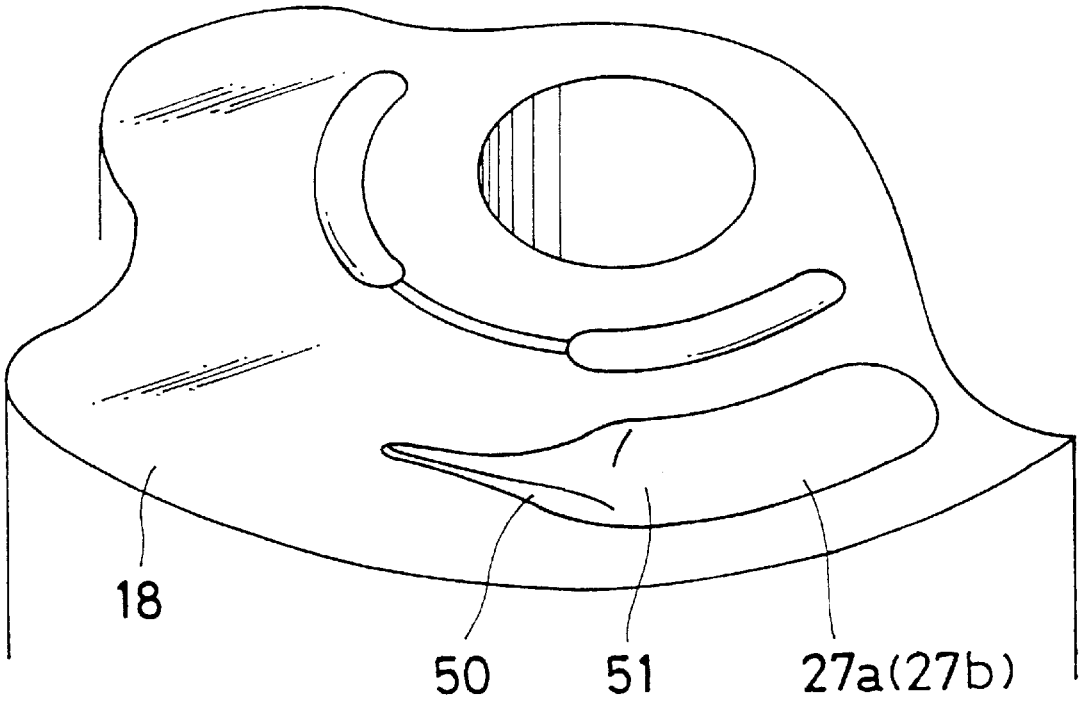
FIG. 4 is an enlarged perspective view of the bearded groove and the introducing portion shown in FIG. 3.
Figure 8:
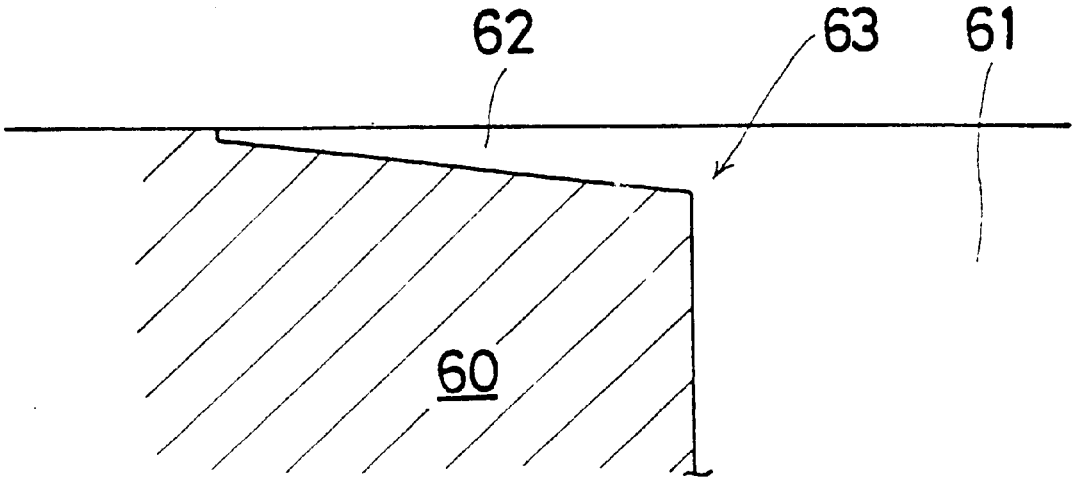
Fig. 8 PRIOR ART
FIG. 8 is an enlarged sectional view of a bearded groove formed on a side face of an end wall structure in a conventional vane type rotary pump.
Figures 9, 9B:
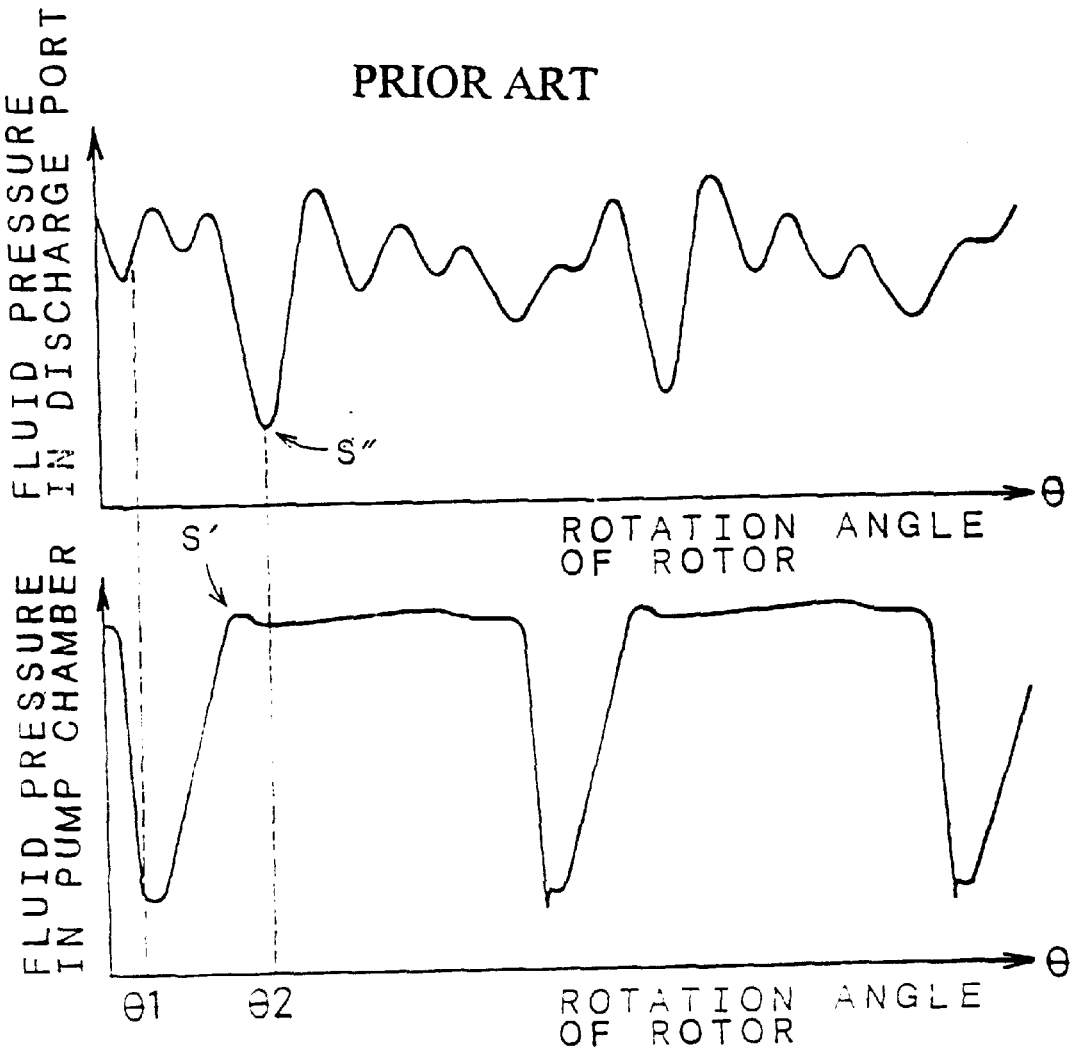
Fig. 9 (a) PRIOR ART
Fig. 9(b) PRIOR ART
FIG. 9(*a*) is a graph showing fluid pressure in a discharge port of the conventional rotary pump in relation to a rotation angle of a rotor in the conventional rotary pump.

In the rotary pump described above, the left-hand end wall member 18 is formed at its inside face with a pair of diametrically opposed bearded grooves 50 which are tapered from the discharge ports 27*a*, 27*b* respectively in a direction opposite to a rotational direction of the rotor 22. The bearded grooves 50 are located at each forward end of the discharge ports 27*a*, 27*b* to be first communicated with the pump chambers P1, P2 respectively during rotation of the rotor 22. As shown in FIGS. 3 and 4, the bearded grooves 50 each are formed with an introducing portion 51 the surface of which is smoothly curved in cross-section into each interior of the discharge ports 27*a*, 27*b*. The bearded groove 50 corresponds with the bearded groove 62 of the conventional vane type rotary pump in FIG. 8.

Assuming that the rotor 22 is rotated counterclockwise by the drive shaft 15 under a loaded condition, the fluid from inlet port 44 is sucked into the pump chambers P1, P2 through the bypass passage 28, cavity 41 and suction ports 25*a*, 25*b* and compressed in the pump chambers P1, P2 to be discharged form the discharge ports 27*a*, 27*b*. During such operation of the rotary pump, the pressure in both the pump chambers P1, P2 each formed by adjacent vanes 21 rapidly increases as shown in FIG. 5(*b*) when the suction ports 25*a*, 25*b* are fully closed by the adjacent vanes 21 at a precompression stroke θ1. in such an instance, both the pump chambers P1, P2 are communicated to one another through the notches 33, 34 and communication groove 35 to moderate the rapid increase of the pressure.

Figures 5A, 5B:
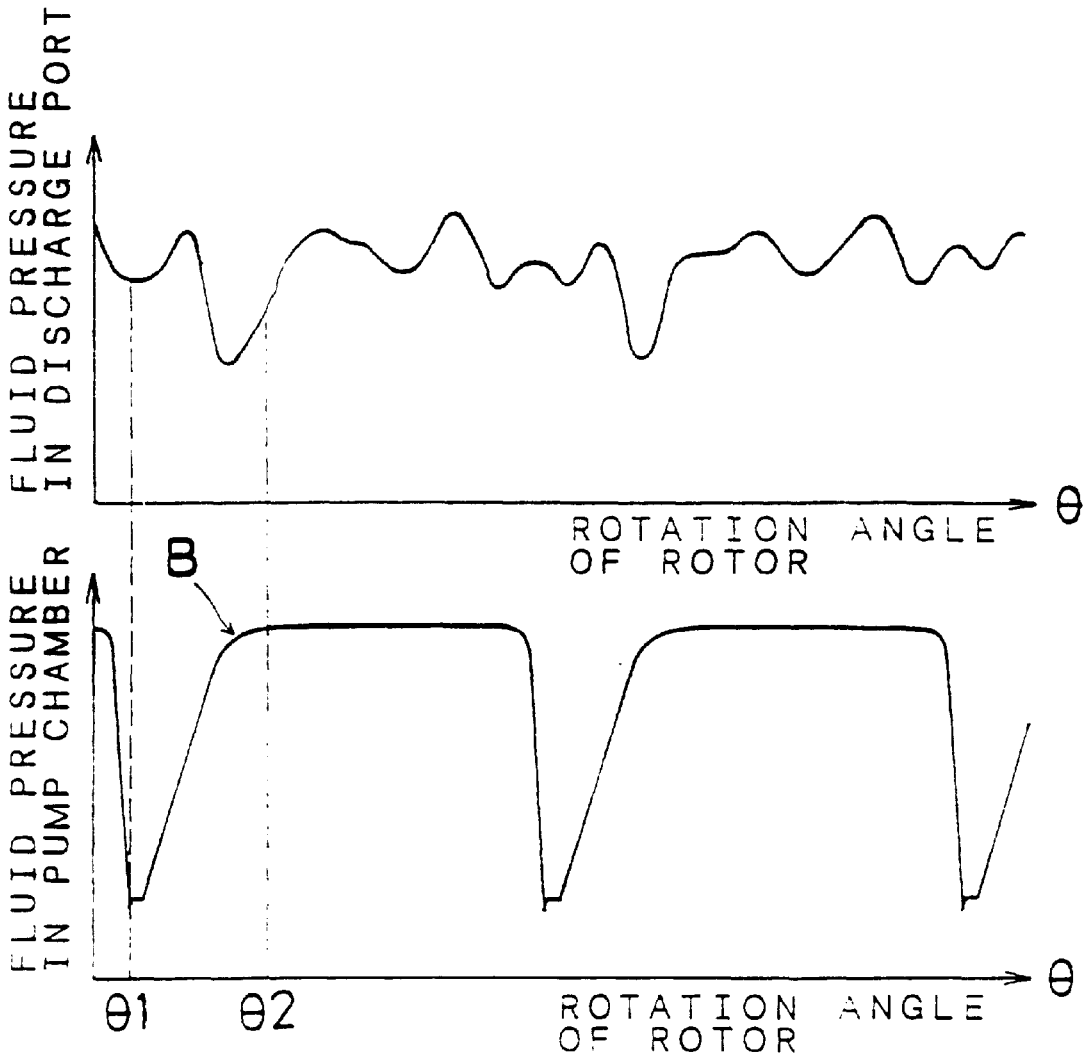
FIG. 5(*a*) is a graph showing fluid pressure in a discharge port of the rotary pump in relation to a rotation angle of a rotor in the rotary pump.

When the pump chambers P1, P2 are displaced from a compression stroke to communicate with each interior of the discharge ports 27*a*, 27*b*, the fluid pressure changes as shown in FIG. 5(*a*), while the pressure in the pump chambers P1, P2 changes as shown in FIG. 5(*b*). In such an instance, the introducing portion 51 acts to smoothly introduce fluid under high pressure from the discharge ports 27*a*, 27*b* into the pump chambers P1, P2 immediately before the discharge ports 27*a*, 27*b* are fully opened. As a result, the pressure in the pump chambers P1, P2 smoothly increases as shown by a character B in FIG. 5(*b*). This is effective to avoid a rapid increase of the fluid pressure at the discharge ports 27*a*, 27*b* and to reduce pulsation of the fluid under pressure.

Figure 6:
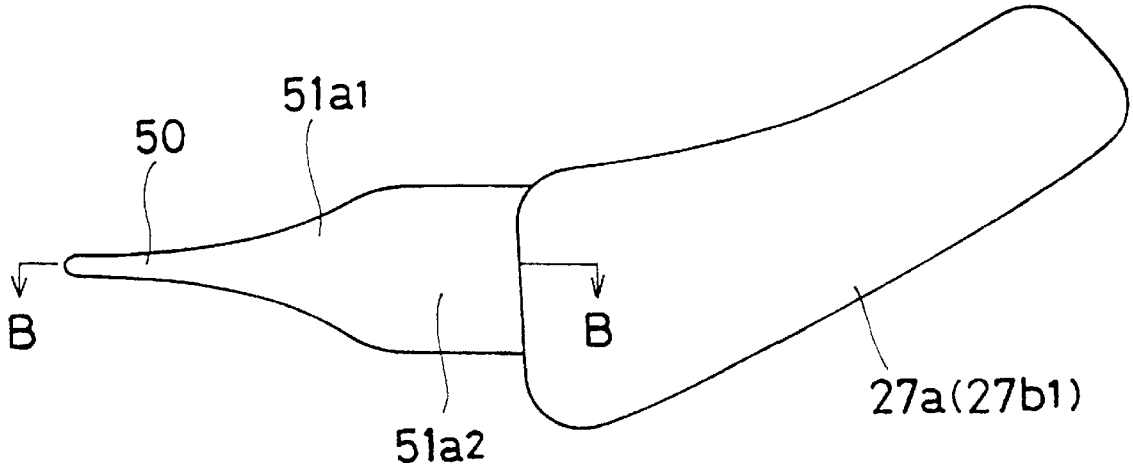
FIG. 6 is a plan view of a modification of the introducing portion shown in FIGS. 3 and 4.
Figure 7A:
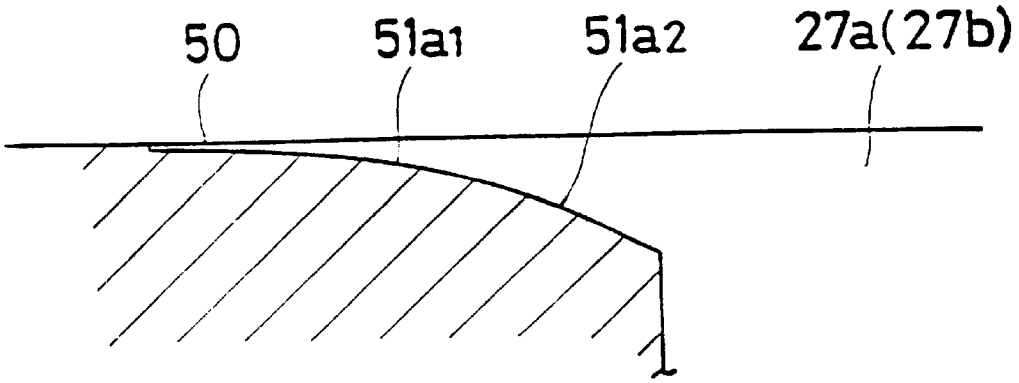
FIG. 7(*a*) is a cross-sectional view taken along line B—B in FIG. 6.
Figure 7B:
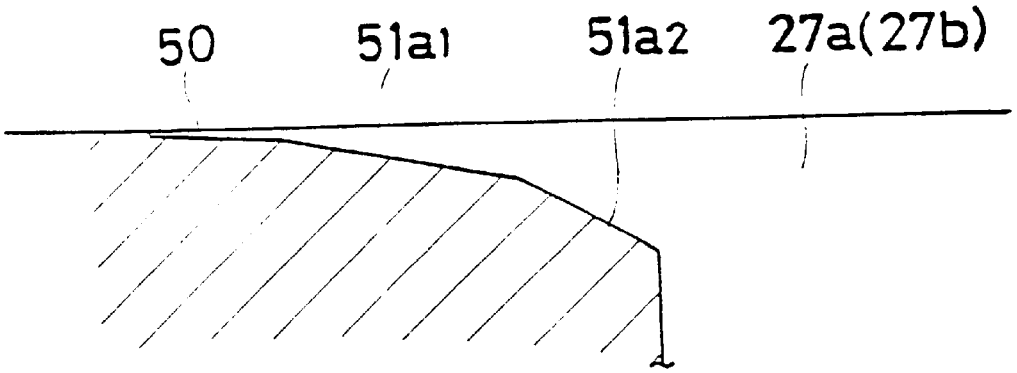

In a practical embodiment of the present invention, the bearded groove 50 formed on the inside face of the left-hand end wall member 18 may be modified as shown in FIGS. 6 and 7(*a*), wherein the introducing portion 51 comprises a curved surface 51*a*1 and a flat surface 51*a*2 which are gradually inclined into each interior of the discharge ports 27*a*, 27*b*. Alternatively, as shown in FIG. 7(*b*) the introducing portion 51 may comprise a plurality of flat surfaces 51*a*1 and 51*a*2 which are gradually inclined into each interior of the discharge ports 27*a*, 27*b*.

What is claimed is:

1. A vane type rotary pump comprising:

a stator housing;

a cam ring formed at its inner periphery with a cam surface and mounted with the stator rotor;

a pair of end well structures fitted to opposite ends of the cam ring to form a pump cavity in the cam ring;

a drive shaft rotatably mounted within the stator housing and extending into the interior of the pump cavity through one of the end wall structures;

a rotor contained within the cam ring and mounted on the drive shaft for rotation therewith;

a plurality of circumferentially equally spaced vanes positioned in the body of the rotor to move radially outward from the rotor and cooperating with the cam surface of the cam ring to form a plurality of expandable pump chambers, at least one suction port formed on an inside face of one of the wall structures at a portion where the pump chambers expand as the vanes move radially outward; and at least one discharge port formed on the inside face thereof at a portion where the pump chambers contract as the vanes move radially inward, the discharge port being configured so as to be formed with at least one bearded groove which is tapered from a forward end of the discharge port in a direction opposite a rotational direction of the rotor, wherein said at least one bearded groove is formed with an introducing portion the surface of which is inclined into the interior of the discharge port, said introducing portion comprising at least first and second differently configured portions which are continuously connected with each other.

2. A vane type rotary pump as claimed in claim 1, wherein said at least first and second portions are respectively formed with a curved surface and a flat surface which are gradually inclined into the interior of the discharge port.

3. A vane type rotary pump as claimed in claim 1, wherein said at least first and second portions are formed with a plurality of flat surfaces which are gradually inclined into the interior of the discharge port.

* * * * *